US011441334B2

(12) United States Patent
Wang

(10) Patent No.: US 11,441,334 B2
(45) Date of Patent: Sep. 13, 2022

(54) LOCK, LID LOCK AND LOCKING MECHANISM

(71) Applicant: Illinois Tool Works Inc., Glenview, IL (US)

(72) Inventor: Yang Wang, Dongguan (CN)

(73) Assignee: Illinois Tool Works Inc., Glenview, IL (US)

( * ) Notice: Subject to any disclaimer, the term of this patent is extended or adjusted under 35 U.S.C. 154(b) by 507 days.

(21) Appl. No.: 16/428,602

(22) Filed: May 31, 2019

(65) Prior Publication Data

US 2019/0368106 A1 Dec. 5, 2019

(30) Foreign Application Priority Data

Jun. 4, 2018 (CN) ..... 201810565017.X

(51) Int. Cl.
*E05B 63/00* (2006.01)
*E05B 9/02* (2006.01)
(Continued)

(52) U.S. Cl.
CPC ..... *E05B 47/023* (2013.01); *D06F 37/42* (2013.01); *E05B 9/02* (2013.01); *E05B 17/0062* (2013.01);
(Continued)

(58) Field of Classification Search
CPC ..... E05B 47/023; E05B 9/02; E05B 17/0062; E05B 17/22; E05B 47/0001;
(Continued)

(56) References Cited

U.S. PATENT DOCUMENTS 5,823,017 A * 10/1998 Hapke ..... D06F 37/42 68/12.26
7,251,961 B2 * 8/2007 Hapke ..... D06F 34/20 68/12.26
(Continued)

FOREIGN PATENT DOCUMENTS

CN 105839352 A * 8/2016 ..... D06F 37/28
EP 1544387 A2 12/2004
(Continued)

OTHER PUBLICATIONS

International Preliminary Report on Patentability and Written Opinion PCT/US2019/035119; dated Dec. 8, 2020.
(Continued)

*Primary Examiner* — Kristina R Fulton
*Assistant Examiner* — Tal Saif
(74) *Attorney, Agent, or Firm* — Boyle Fredrickson, S.C.

(57) ABSTRACT

A lock, a lid lock and a locking mechanism are provided. The lock includes a base, and a driving mechanism, a connecting mechanism and a locking mechanism which are provided on the base. The base is buckled to a housing. The connecting mechanism has a first end connected to the driving mechanism, and a second end thereof connected to the locking mechanism. The locking mechanism is rotatably connected to the base to perform a locking operation or an unlocking operation. A return spring is sleeved on the locking mechanism, one end of the return spring is connected to the housing, and the other end to the locking portion of the locking mechanism. The locking mechanism is connected to a control system. In the unlocking operation, the control system determines that the locking portion is disconnected to the return spring according to the locking portion in an unfolded position relative to the base, and determines that the locking mechanism is connected to the
(Continued)

return spring according to the locking mechanism in a retracted position relative to the base.

19 Claims, 5 Drawing Sheets

(51) Int. Cl.

| | |
|---|---|
| ***E05C 1/08*** | (2006.01) |
| ***E05B 63/20*** | (2006.01) |
| ***E05B 15/04*** | (2006.01) |
| ***E05B 47/02*** | (2006.01) |
| ***D06F 37/42*** | (2006.01) |
| ***E05B 17/00*** | (2006.01) |
| ***E05B 17/22*** | (2006.01) |
| ***E05B 47/00*** | (2006.01) |
| *D06F 39/14* | (2006.01) |

(52) U.S. Cl.
CPC ..... *E05B 17/22* (2013.01); *E05B 47/0001* (2013.01); *D06F 39/14* (2013.01); *E05B 2047/0069* (2013.01); *E05Y 2900/312* (2013.01)

(58) Field of Classification Search
CPC ..... E05B 2047/0069; E05B 47/00; E05B 47/0002; E05B 47/0003; E05B 47/0004; E05B 47/06; E05B 47/0603; E05B 2047/0016; E05B 2047/0067; E05B 2047/0065; E05B 65/1026; E05B 17/0054; D06F 37/42; D06F 39/14; E05Y 2900/312; A47L 15/4259; Y10T 292/1047; Y10T 292/1082; Y10S 292/69
See application file for complete search history.

(56) References Cited

U.S. PATENT DOCUMENTS

| | | | | |
|---|---|---|---|---|
| 9,926,728 | B2 * | 3/2018 | Promutico | D06F 37/42 |
| 2008/0042447 | A1 * | 2/2008 | Neumann | E05C 19/02 292/216 |
| 2011/0252844 | A1 * | 10/2011 | Shoemaker | E05B 53/001 292/201 |
| 2012/0312594 | A1 | 12/2012 | Hapke et al. | |
| 2018/0008120 | A1 * | 1/2018 | Dirnberger | E05C 3/24 |

FOREIGN PATENT DOCUMENTS

| | | | | |
|---|---|---|---|---|
| EP | 1544387 | A2 * | 6/2005 | D06F 37/42 |
| WO | WO-8100426 | A1 * | 2/1981 | E05B 65/108 |
| WO | WO-9949159 | A1 * | 9/1999 | E05B 81/14 |
| WO | WO-2011109235 | A1 * | 9/2011 | D06F 37/42 |
| WO | 2012/042551 | A1 | 4/2012 | |
| WO | 2016/082744 | A1 | 6/2016 | |
| WO | WO-2016082744 | A1 * | 6/2016 | D06F 34/28 |

OTHER PUBLICATIONS

International Search Report for Application PCT/US2019/035119; dated Oct. 1, 2019.

* cited by examiner

LOCK, LID LOCK AND LOCKING MECHANISM

TECHNICAL FIELD

The present application relates to a mechanical lock, and in particular to a lock, a lid lock and a locking mechanism.

BACKGROUND

Presently, an electrical device usually requires to install a locking mechanism of a high security level. Taking a washing machine as an example, a lock may be used to lock an upper lid to prevent the upper lid from opening when the washing machine runs at a high speed (or when the machine still runs at a high speed after being turned off due to inertia).

However, when a user forces to open the upper lid, a locking portion of the lock tends to be broken off, which may cause the security protection to fail. At this point, it is necessary to prevent the electrical device being activated again after the user covers the upper lid, which will cause unsafe factors that may hurt the human body.

SUMMARY

Embodiments of the present application provide a lock, a lid lock and a locking mechanism to solve or alleviate at least one or more technical problems in prior arts, and at least to provide a helpful option or create a favorable condition for this purpose.

In order to achieve the above objectives, in one aspect of the present application, a lock is provided according to an embodiment of the present application. The lock includes a base, and a driving mechanism, a connecting mechanism and a locking mechanism which are provided on the base;

a housing is buckled on the base, and a cavity is formed between the housing and the base, and the driving mechanism, the connecting mechanism and the locking mechanism are accommodated in the cavity;

the connecting mechanism has a first end connected to the driving mechanism, and a second end connected to the locking mechanism, the connecting mechanism if configured for converting a linear motion of the driving mechanism into a rotating motion of the locking mechanism; locking mechanism is rotatably connected to the base to perform a locking operation or unlocking operation;

a return spring is sleeved on the locking mechanism, the return spring has a first protruding end connected to the housing and a second protruding end connected to the locking mechanism, in the unlocking operation, the return spring drives the locking mechanism to retract relative to the base;

the locking mechanism is connected to a control system; and in the unlocking operation, the control system determines that the locking portion is disconnected to the return spring according to the locking mechanism in an unfolded position, and determines that the locking mechanism is connected to the return spring according to the lock mechanism in a retracted position relative to the base.

In an embodiment of the present application, the locking mechanism includes a locking shaft and a locking portion, the locking shaft is rotatably connected to the base, and the return spring is sleeved on the locking shaft;

the locking portion is provided on an upper portion of the locking shaft and is connected to the locking shaft through a fragile portion, and the locking portion is rotated on the locking shaft to unfold or retract relative to the base.

In an embodiment of the present application, the fragile portion is in a shape of curve, the locking portion is provided with an insertion hole, and the second protruding end passes through the insertion hole and is clamped on the locking portion.

In an embodiment of the present application, the first end of the connecting mechanism is connected to the driving mechanism through a sliding mechanism, and the lock further includes a circuit board electrically connected to a power supply and a dome switch connected to the sliding mechanism.

In an embodiment of the present application, the circuit board includes a first contacting unit and a second contacting unit;

in the unfolded position of the locking mechanism with respect to the base, the dome switch comes into contact with the first contacting unit;

in the retracted position of the locking mechanism with respect to the base, the dome switch comes into contact with the second contacting unit; in the unlocking operation, the control system determines that the locking section is disconnected to the return spring according to the dome switch in contact with the first contacting unit, and determines that the locking section is connected to the return spring according to the dome switch in contact with the second contacting unit.

In an embodiment of the present application, the control system includes:

a driving control unit configured to receive information of a previous power failure sent by a device and send an activation signal to the driving mechanism to rotate the locking mechanism relative to the base to perform the operation of locking or unlocking;

a breakage determining unit configured to determine that the locking section is disconnected to the return spring according to the dome switch in contact with the first contacting unit in the unlocking operation; and determines that the locking section is connected to the return spring according to the dome switch in contact with the second contacting unit; and a running control unit configured to send a stop-running signal to the device in a case of a disconnection between the locking portion and the return spring; send the activation signal to the driving mechanism again in a case of a connection between the locking portion and the return spring, to drive the sliding mechanism and the connecting mechanism to move by driving mechanism, and rotate the locking mechanism relative to the base to perform the locking operation; and send a normal-running signal to the lock to the device.

In an embodiment of the present application, the lock further includes a magnetic reed switch connected to the control system and conducted by a magnetic force.

In an embodiment of the present application, the magnetic reed switch is connected to the driving control unit; and the driving control unit is further configured to receive the information of the previous power failure sent by the device and a signal of the magnetic reed switch being in an on position, and send the activation signal to the driving mechanism.

In an embodiment of the present application, the magnetic reed switch is connected to the running control unit; and the running control unit is further configured to send a stop-running signal to the device when a signal of the magnetic reed switch being in an off position is received.

In an embodiment of the present application, the connecting mechanism includes a crank lever, the locking mechanism includes a main rotating shaft, and the locking mechanism is rotatably connected to the base through the main rotating shaft;

one end of the crank lever is connected to the sliding mechanism, and the other end of the crank level is connected to the main rotating shaft; and when the sliding mechanism moves, the main rotating shaft rotates relative to the base by a driving of the crank lever and drives the locking portion to rotate.

In an embodiment of the present application, an outside portion of the housing is provided with a window; and the locking portion in the retracted position is accommodated in the window.

In a second aspect of the present application, a lid lock is provided according to an embodiment of the present application, including an upper lid, a casing, and the above lock; wherein, the upper lid is buckled on the casing;

the lock is arranged in the casing, and the upper lid is provided with a locking hole at a position corresponding to the lock; and the locking portion rotatably protrudes relative to the casing and is locked in the locking hole.

In an embodiment of the present application, the upper lid is provided with a magnetic element, and the magnetic reed switch switches on under a magnetic force and the driving mechanism is connected to the power supply when the upper lid is buckled to the casing.

In a third aspect of the present application, a locking mechanism for a lock is provided according to an embodiment of the present application. The lock includes a housing, within which the locking mechanism is arranged;

the locking mechanism includes a locking shaft and a locking portion, and a fragile portion located between the locking shaft and the locking portion, the fragile portion is broken off when subjected to an external force greater than a predetermined threshold;

the locking mechanism is provided with a return spring, which is sleeved on the locking shaft, the return spring includes a first protruding end connected to the housing and a second protruding end connected to the locking portion; and when the fragile portion is broken off, the second protruding end is disconnected to the locking portion.

In a fourth aspect of the present application, a lock is provided according to an embodiment of the present application, which includes the locking mechanism described in the third aspect.

Some of the above technical solutions have the advantages or beneficial effects of providing protection in case of failure when the locking portion is broken off.

The above summary only intends to illustrate the purpose of the description, and does not intend to be limiting in any form. In addition to the above described illustrative aspects, embodiments and features, further aspects, embodiments and features of the present application will be readily understood by reference to the accompanying drawings and the detailed description below.

BRIEF DESCRIPTION OF THE DRAWINGS

The same reference numerals in the drawings will be used to refer to the same or like parts or elements throughout the drawings, unless specified otherwise. These drawings may not be necessarily drawn according to the scales. It should be understood that these drawings only depict some embodiments of the present application, and shall not be regarded as limiting to the scope of the present application.

DETAILED DESCRIPTION OF THE EMBODIMENTS

In the following, only some embodiments are briefly described. As can be recognized by those skilled in the art, various modifications may be made to the described embodiments without departing from the spirit or scope of the present application. Therefore, the drawings and the description are substantially regarded as exemplary intrinsically rather than restrictive.

In the first aspect of the present application, a lock 100 is provided.

The lock 100 of the present application will be described below with reference to the drawings.

Figure 1:
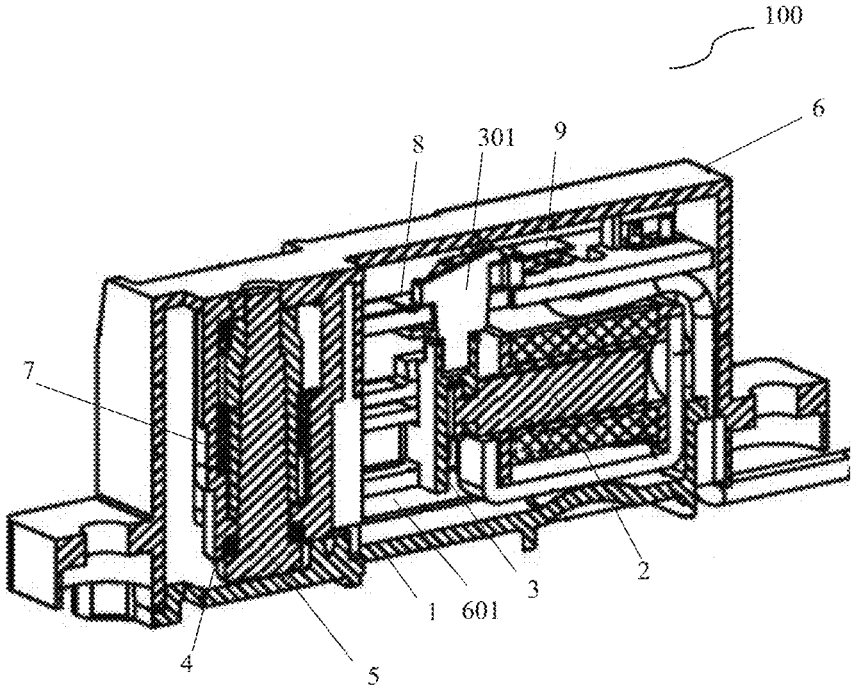
FIG. 1 is a schematic structural cross-sectional view of a lock according to an embodiment of the present application.
Figure 2:
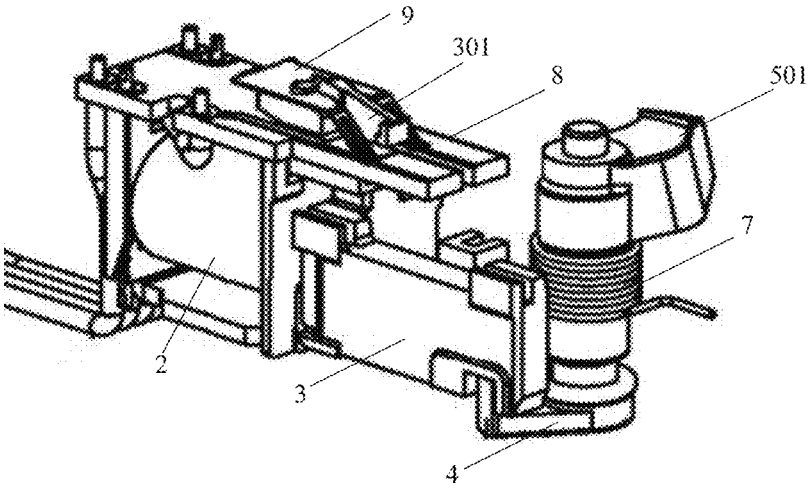
FIG. 2 is a schematic structural view of the lock according to an embodiment of the present application, with the housing and the base removed.
Figure 8:
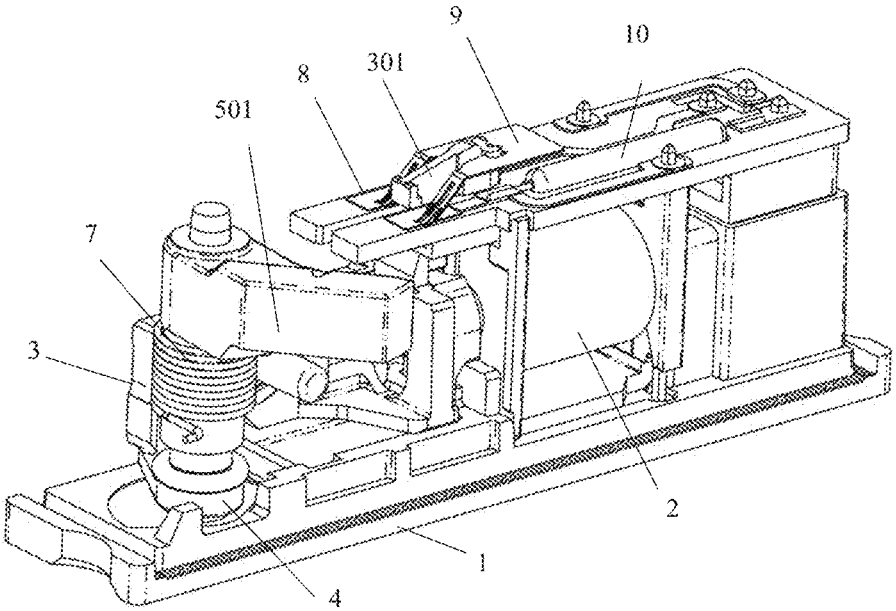
FIG. 8 is a schematic structural view of the lock with the housing removed according to another embodiment of the present application.

Now referring to FIGS. 1, 2 and 8, in an embodiment, the lock 100 in the present application includes a base 1; and a driving mechanism 2, a connecting mechanism 4, and a locking mechanism 5 which are provided on the base 1. Here, the driving mechanism 2 is not specifically limited, and the driving mechanism 2 may be but not limited to the magnetic driving mechanism in FIG. 2.

In an embodiment, the base 1 is buckled to a housing 6, and a cavity 601 can be formed between the housing 6 and the base 1. The driving mechanism 2, the connecting mechanism 4, and the locking mechanism 5 may be accommodated in the cavity 601.

Here, the connecting mechanism 4 may include a first end connected to the driving mechanism 2, and a second end connected to the locking mechanism 5, such that the connecting mechanism 4 may convert the linear motion of the driving mechanism 2 into rotational motion of the locking mechanism 5. Therefore, in the rotation of the locking mechanism 5, a locking portion 501 thereof can be unfolded or retracted relative to the base 1. It is easy to understand that an angle of the locking portion 501 relative to the base is in a range, which can be set as needed. In general, when the locking portion 501 is unfolded to the maximum angular position, i.e., in the unfolded position, the locking operation is performed; when the locking portion 501 is retracted to the minimum angular position, i.e., in the retracted position, the unlocking operation is performed.

Referring to FIGS. 2 and 8, in an embodiment, the driving mechanism 2 and the connecting mechanism 4 may be connected by a sliding mechanism 3. The driving mechanism 2 may drive the sliding mechanism 3 to move linearly on the base 1. The first end of the connecting mechanism 4 is connected to the sliding mechanism 3, and the second end to the locking mechanism 5. The locking mechanism 5 is rotatably connected to the base 1. The lock may be provided with an engaging mechanism that is engaged with the sliding mechanism 3. Thus, in the locking operation, the sliding mechanism 3 is engaged with an engaging mechanism, the locking mechanism 5 (the locking portion 501) is restrained to remain in the unfolded position. In the unlocking operation, the sliding mechanism 3 is disengaged from the engaging mechanism, and under the action of a return spring 7, the locking mechanism 5 (locking portion 501) returns to the retracted position.

The engaging mechanism, and the connection between the sliding mechanism and the engaging mechanism, are similar to the implementation of a "refill" and have been described in Chinese Patent Publication of CN 1056249977.4, which will not be described herein. Further, the return spring 7 includes a first protruding end 701 connected to the housing 6, and a second protruding end 702 connected to the locking portion 501 (shown in FIG. 3).

Figure 10:
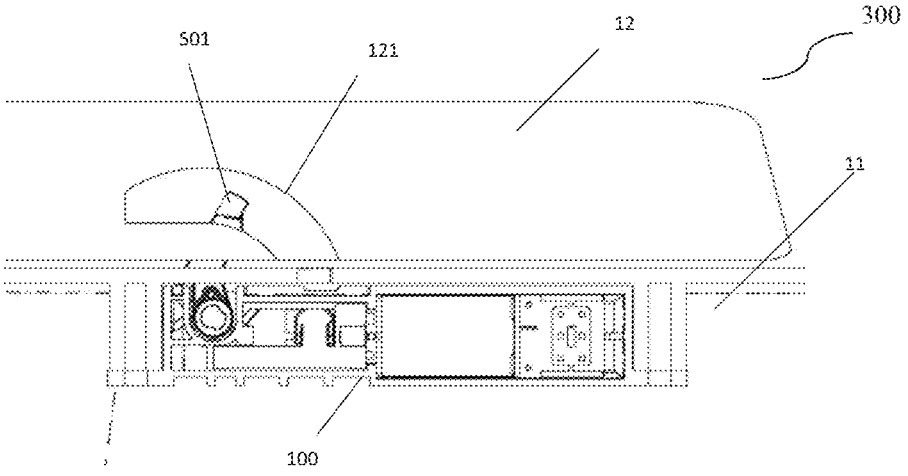
FIG. 10 is a schematic structural view of the lid lock when the locking portion is in the unfolded position according to an embodiment of the present application.

In an embodiment, specifically, referring to FIG. 2, when it is required to perform the locking operation, the driving mechanism 2 is activated to push the sliding mechanism 3, and the sliding mechanism 3 pulls the connecting mechanism 4 to rotate clockwise by overcoming the spring force of the return spring 7. Thus, the locking portion 501 can be rotated clockwise with respect to the base 1 and unfolded to the unfolded position. At this point, the locking mechanism 3 engages with the engaging mechanism. As shown in FIG. 10, the locking portion 501 can protrude into a locking hole 121 that matches therewith.

Figure 9:
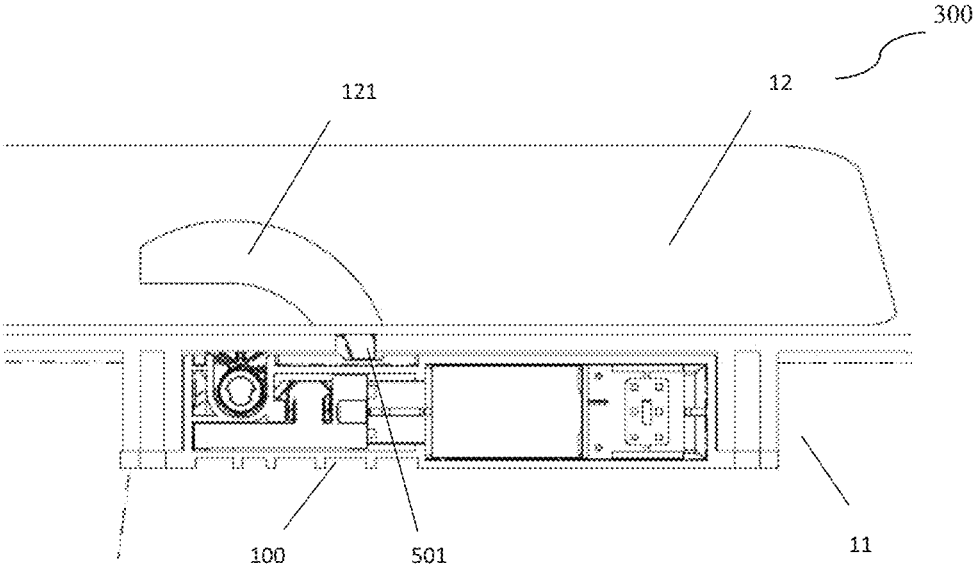
FIG. 9 is a schematic structural view of the lid lock when the locking portion is in the retracted position according to an embodiment of the present application.

Referring to FIG. 2, when it is required perform the unlocking operation, the driving mechanism 2 is activated again, which pushes the sliding mechanism 3 to move. At this point, the locking mechanism 3 is disengaged from the engaging mechanism, and under the return force of the return spring 7, the locking portion 501 can be rotated counterclockwise with respect to the base 1 and return to the retracted position. Moreover, under the return force of the return spring 7, the connecting mechanism 4 and the sliding mechanism 3 return to the original position to prepare for the next locking operation. As shown in FIG. 9, the locking portion 501 is rotated out of the locking hole 121.

In an embodiment, the locking mechanism 5 is connected to a control system 200 (shown in FIG. 4, described in detail below). In the unlocking operation, the control system 200 can determine that the locking portion 501 is disconnected to the return spring 7 according to the locking mechanism 5 (locking portion 501) in the unfolded position with respect to the base 1, and determine that the locking portion 501 is connected to the return spring 7 according to the locking mechanism 5 in the retracted position with respect to the base 1.

Figure 5:
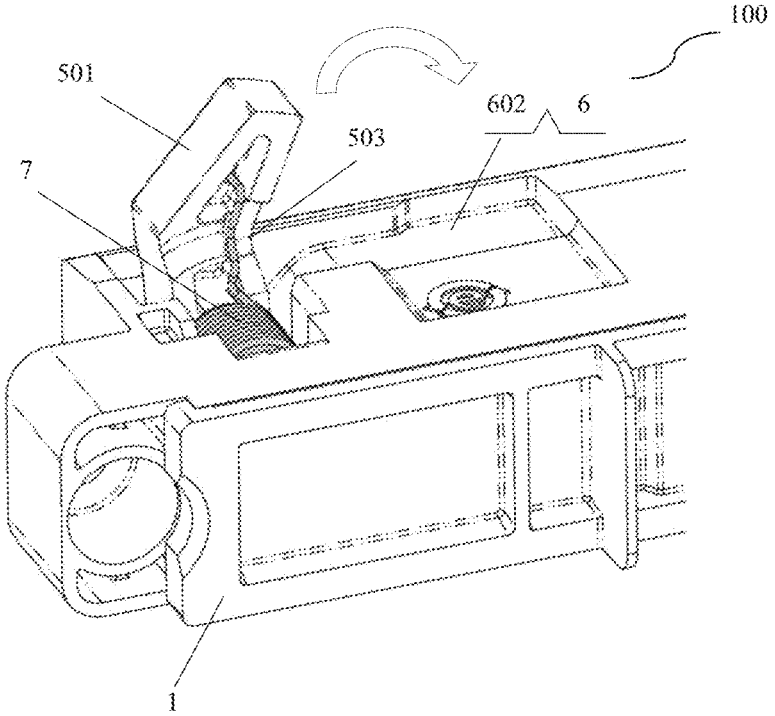
FIG. 5 is a schematic view of the lock when the locking portion is in an unfolded position according to an embodiment of the present application.
Figure 6:
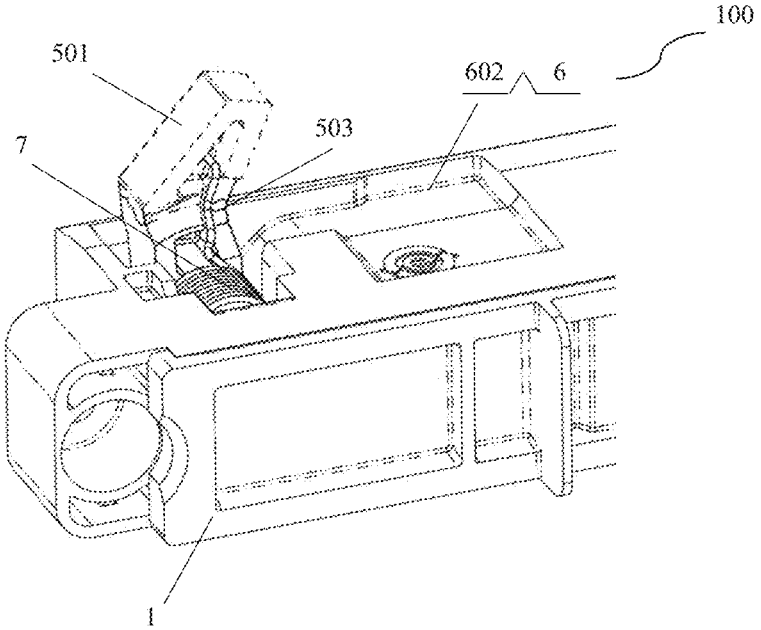
FIG. 6 is a schematic view of the lock when the locking portion is broken off according to an embodiment of the present application.
Figure 7:
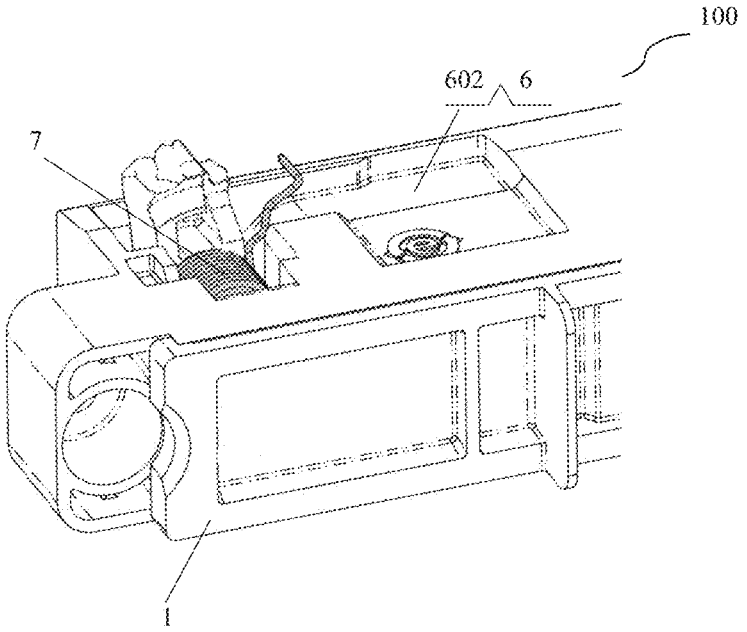
FIG. 7 is a schematic view of the lock after the locking portion is broken off according to an embodiment of the present application.

Specifically, referring to FIG. 5, the locking mechanism 5 (locking portion 501) is in the unfolded position, i.e., the locking operation is performed. At this point, if the unlocking operation is performed, the return spring 7 will exert a return force (the direction of the arrow represents the direction of action of the return spring 7). If the locking portion 501 remains in connection with the return spring 7, the locking portion 501 will be retracted relative to the base 1 under the action of the return spring 7, and the locking mechanism 5 can be rotated relative to the base 1 and return to the retracted position. As shown in FIGS. 6 and 7, if the locking portion 501 is disconnected to the return spring 7, the locking portion 501 will not be subjected to the force of the return spring 7, and the locking mechanism 5 will not be rotated relative to the base 1 but stay in the unfolded position.

Therefore, in the unlocking operation, the control system 200 can determine the locking portion 501 is disconnected to the return spring 7, i.e., the lock fails, if the locking mechanism 5 is in the unfolded position relative to the base 1, determine that the locking portion 501 remains being connected to the return spring 7, i.e., the lock is available, if the locking mechanism 5 is in the retracted position relative to the base 1.

In an embodiment, after determining that the lock has failed, the control system 200 may transmit a failure signal, for example, to an electrical device equipped with the lock, and facilitate the electrical device to stop running or enter into an alarm mode so as to protect in case of failure.

It should be noted that the wording "forward", "rear", "up", "down" and other orientation terms described herein are all set for convenience of description, and do not necessarily correspond exactly to the spatial front, back, and bottom up and down.

Figure 3:
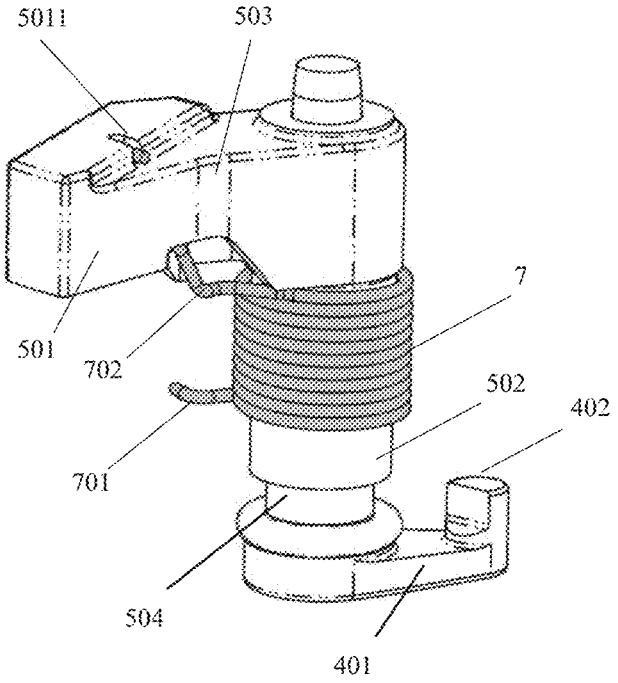
FIG. 3 is a schematic structural view of a locking mechanism of a lock according to an embodiment of the present application.

Referring to FIG. 3, in an embodiment, the locking mechanism 5 includes a locking portion 501 and a locking shaft 502, wherein the locking shaft 502 is rotatably connected to the base 1, and the return spring 7 is sleeved on the locking shaft 502. In addition, the locking portion 501 may be provided on an upper portion of the locking shaft 502 and may be unfolded or retracted relative to the base 1 as the locking shaft 502 rotates.

In an embodiment, referring to FIG. 3, further, the locking portion 501 is provided with an insertion hole 5011, and the second protruding end 702 may pass through the insertion hole 5011 and clamp on the locking portion 501. Thereby the return spring 7 can bring the locking portion 501 into rotating. It is noted that the clamping point in which the return spring 7 clamps the locking portion 501 is located in a position other than a fragile point (i.e., further away from the rotary axis of the locking portion 501).

Further, referring to FIG. 5 to FIG. 7, the locking portion 501 is connected to the locking shall 502 through a fragile portion 503. Since the fragile portion 503 is in a shape of curve, when the locking portion 501 is subjected to an external force, for example, under pulling, stress concentration is likely to be formed at the curved portion during the process of the external force being transmitted to the locking shaft 502 and protruding the fragile portion 503, and thus the lock may be broken off at the device portion 503. After the device portion 503 is broken off, the locking portion 501 will be separated from the locking mechanism 5 due to the breakage, and one end of the return spring 7 will also be separated from the locking portion 501, that is, the locking portion 501 will be disconnected to the return spring 7.

In the usage of the lock, for example, when used in a washing machine, the lock often fails to lock properly or starts to loosen when pulled by an excessive force. In this way, the lock cannot be locked securely, and the upper lid may be subjected to centrifugal force or vibration and open when the washing machine is running at a high speed, which may hurt the human body.

In the lock according to the present application, by providing the device portion 503, a device point is created in the locking mechanism 5, so that the lock may be broken off when subjected to an excessive external force. In addition, the control system 200 can determine the failure of the lock according to the disconnection between the return spring and the locking portion, and can stop the operation of the electrical device, so as to protect in case of failure.

Referring to FIGS. 1, 2 and 8, in an embodiment, the lock further includes a circuit board 8 and a dome switch 9, wherein the circuit board 8 is electrically connected to a power supply (not shown). The dome switch 9 is connected to the sliding mechanism 3. In an embodiment, an upper portion of the sliding mechanism 3 may be provided with an indicating block 301 through which the dome switch 9 is connected to the sliding mechanism 3. Thereby, when the locking mechanism 5 is unfolded or retracted relative to the base 1, the sliding mechanism 3 can bring the dome switch 9 into moving. Moreover, when the sliding mechanism 3 slides to a specified position, the dome switch 9 may be in contact with a specified contacting unit on the circuit board 8.

Therefore, in the unlocking operation, the control system 200 can determine whether the locking mechanism 5 is unfolded or retracted relative to the base 1 according to the contact position of the dome switch 9 with the specified contacting unit, so as to determine whether the locking unit 501 is disconnected to the return spring 7.

In an embodiment, as shown in FIG. 2, the circuit board 8 includes a first contacting unit (not shown) and a second contacting unit (not shown) thereon, wherein the first contacting unit may be located at a rear position on the circuit board, and the second contacting unit may be located at a front position on the circuit board.

In the locking operation (the detailed process of which has been described above and will not be described in detail here), that is, when the locking mechanism 5 is in the unfolded position, the dome switch 9 is brought to move backward by the sliding mechanism 3, and thus the dome switch 9 comes into contact with the first contacting unit on the circuit board 8.

In the unlocking operation (the detailed process of which has been described above and will not be described in detail here), that is, when the locking mechanism 5 is in the retracted position, the dome switch 9 is brought to move forward by the sliding mechanism 3, and thus the dome switch 9 comes into contact with the second contacting unit on the circuit board 8.

Therefore, when the locking mechanism 5 (locking portion 501) is in the unfolded position, i.e., after the locking operation being performed, the dome switch 9 comes into contact with the first contacting unit on the circuit board 8; when the unlocking operation is performed, if the dome switch 9 comes into contact with the second contacting unit on the circuit board 8, it means that under the return force of the return spring 7, the dome switch 9 is brought to move backward by the sliding mechanism 3. Thus, it can be confirmed that the return spring 7 remains being connected with the locking portion 501.

On the other hand, if the dome switch 9 remains in contact with the first contacting unit on the circuit board 8, it means that the dome switch 9 is not brought to move by the sliding mechanism 3, which shows that there is no action of the return force and the return spring 7 is disconnected to the locking portion 501.

Figure 4:
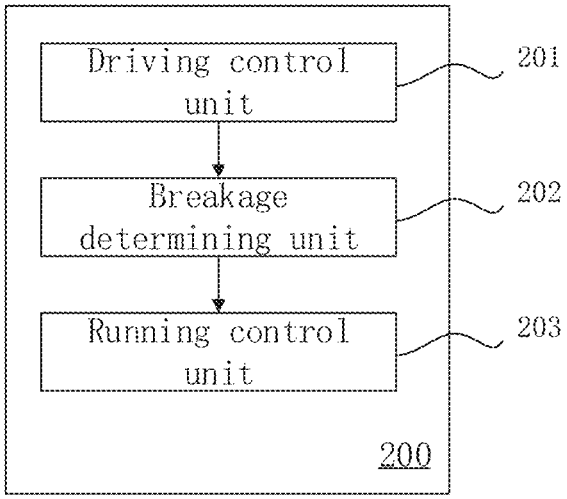
FIG. 4 is a schematic structural view of a control system according to an embodiment of a lock of the present application.

Referring to FIG. 4, in an embodiment, the control system 200 includes a driving control unit 201, a breakage determining unit 202, and an running control unit 203.

When the electrical device encounters a power failure, the power supply is reset again, and the user activates the electrical device again, then the driving control unit 201 can receive information of a previous power failure sent by the device and send an activation signal to the driving mechanism 2. The driving mechanism 2 can drive the sliding mechanism 3 and the connecting mechanism 4 to move and rotate the locking mechanism 5 relative to the base 1 to perform the locking operation. At this point, the dome switch 9 comes into contact with the first contacting unit on the circuit board 8.

Next, the driving control unit 201 again sends a driving signal to the driving mechanism 2 to perform the unlocking operation. At this point, if the locking portion 501 is not disconnected to the return spring 7, the return spring 7 will exert a return force on the locking portion 501 in order to rotate and retract the locking mechanism 5 relative to the base 1, and the dome switch 9 will come into contact with the second contacting unit on the circuit board 8. However, if the locking portion 501 is disconnected to the return spring 7, the return spring 7 cannot exert a return three on the locking portion 501, and the dome switch 9 will come into contact with the first contacting unit on the circuit board 8.

When the unlocking operation is performed, the breakage determining unit 202 can determine the locking portion 501 is disconnected to the return spring 7 according to the contact of the dome switch 9 with the first contacting unit on the circuit board. It is also possible to determine that the locking portion 501 is connected to the return spring 7 according to the contact of the dome switch 9 with the second contacting unit on the circuit board.

Further, when the locking portion 501 is disconnected to the return spring 7, the running control unit 203 may send a stop-running signal to the device. When the locking portion 501 is connected to the return spring 7, the running control unit 204 may send an activation signal to the driving mechanism 2 again. The driving mechanism 2 drives the sliding mechanism 3 and the connecting mechanism 4 to move so that the locking portion 501 is unfolded relative to the base 1 and then the locking operation is performed. Meanwhile, the running control unit 204 can send a normal-running signal to the device in order to drive the device to perform normal-running.

Taking the washing machine as an example, an assumption is that the washing machine in operation suddenly encounters a power failure, the user forcibly opens the upper lid of the washing machine to take out the laundry, and the locking portion of the lock is broken off; the power is supplied again after a period of time, the user closes the upper lid of the washing machine.

In this case, the driving control unit 201 may receive the information of the previous power failure sent by the washing machine and send an activation signal to the driving mechanism 2 to drive the locking mechanism 5 to perform the locking operation, and the dome switch 9 will come into contact with the first contacting unit on the circuit board. Next, the driving control unit 201 again sends a drive signal (of unlocking) to the driving mechanism 2. At this point, the breakage determining unit 202 may determine the locking unit 501 is connected to the return spring 7 according to the dome switch 9 in contact with the first contacting unit on the circuit board. Moreover, when the locking portion 501 is disconnected to the return spring 7, the running control unit 203 may send a stop-running signal to the washing machine.

Therefore, when the locking portion 501 is broken off, the control system 200 can perform determining and stop the running of the washing machine, thus protecting the washing machine in case of failure. Meanwhile, the danger of an unlocked upper lid being opened outward as the washing machine runs at a high speed is avoided.

Referring to FIG. 8. In an embodiment, the lock further includes a magnetic reed switch 10. The magnetic reed switch 10 may be placed inside the lock 100 or outside the lock 100, wherein the magnetic reed switch 10 is connected to the control system 200 and is conducted by a magnetic force. In other words, when the magnetic reed switch 10 is not subjected to a magnetic force, the magnetic reed switch 10 is not conducted to the control system 200; when the magnetic reed switch 10 is subjected to a magnetic force, the magnetic reed switch 10 is conducted to the control system 200. For example, referring to FIGS. 9 to 10, when the lock is employed to a lid lock, a magnetic element (not shown in the drawing) may be placed in the upper lid 12. When the upper lid 12 is buckled to the casing 11, the magnetic reed switch 10 is conducted to the control system 200 by the magnetic force of a magnet.

In an embodiment, the magnetic reed switch 10 is connected to the driving control unit 201. After the electrical device encounters a power failure, the power supply is reset again, and the user again covers the upper lid and activates the electrical device, then the driving control unit 201 can receive the information of a previous power failure and a signal of the magnetic reed switch 10 being in an on position sent by the device, and send an activation signal to the driving mechanism 2.

At this point, the control system 200 can determine that the upper lid 12 has been buckled and activate the driving mechanism 2 to move the driving mechanism 2 and drive the locking mechanism 5 to rotate, so as to perform the locking operation.

Taking the washing machine as an example, an assumption is that the washing machine in operation suddenly encounters a power failure, the user forcibly opens the upper lid of the washing machine to take out the laundry, and the locking portion of the lock is broken off; the power is supplied again after a period of time, the user does not close the upper lid of the washing machine.

In this case, since the driving control unit 201 does not receive the signal of the magnetic reed switch 10 being in an on position, it will not send the activation signal to the driving mechanism 2. Until the user covers the upper lid of the washing machine again, the driving control unit 201 may receive the information of the previous power failure and the signal of the magnetic reed switch being in an on position sent by the device, and send the activation signal to the driving mechanism 2 to drive the locking mechanism 5 to perform the lock operation, and the dome switch 9 comes into contact with the first contacting unit on the circuit board. Next, the driving control unit sends a drive signal (of unlocking) again to the driving mechanism 2. At this point, the breakage determining unit 202 may determine the locking portion 501 is disconnected to the return spring 7 according to the dome switch 9 in contact with the first contacting unit on the circuit board. Also, when the locking portion 501 is disconnected to the return spring 7, the running control unit 203 may send a stop-running signal to the washing machine.

In an embodiment, the magnetic reed switch 10 is connected to the running control unit 203. When receiving a signal of the magnetic reed switch 10 being in an off position, the running control unit 203 may send the stop-running signal to the device.

Taking the washing machine as an example, an assumption is that the washing machine is running, and the user forcibly opens the upper lid in order to take out the laundry.

In this case, when the running control unit 203 receives the signal of the magnetic reed switch 10 being in an off position, it may send a stop-running signal to the washing machine to stop the running of the washing machine, so as to avoid causing unsafe factors that may hurt the human body.

Referring to FIG. 3, in an embodiment, the connecting mechanism 4 includes a crank lever 401, wherein one end of the crank lever 401 may be connected to the sliding mechanism 3 through the rotation shaft 402. In an embodiment, the crank lever 401 is attached to the lower portion of the sliding mechanism 3. The other end of the crank lever 401 is connected to the main rotating shaft 504 of the locking mechanism 5, so that the main rotating shaft 504 can rotate relative to the base 1 under the driving of the crank lever 401. That is, when the sliding mechanism 3 moves linearly, the main rotating shaft 504 can rotate relative to the base 1. Further, the locking shaft 502 is sleeved on the main rotating shaft 504 and rotates coaxially with the main rotating shaft, so that the locking portion 501 can be rotated relative to the base 1, thus being unfolded or retracted.

Referring to FIG. 6, in an embodiment, an outside portion of the housing 6 is provided with a window 602. When the locking portion 501 is in the retracted position, the locking portion 501 can be accommodated in the window 602. In this way, the locking portion 501 in the retracted position will not protrude relative to the housing 6, ensuring an overall aesthetic appearance.

In a second aspect of the present application, a lid lock 300 employing a lock 100 and a control system 200 is provided. The lock 100 and the control system 200 can be applied in various fields of a lid lock, and is preferably applied to a lid lock of a wave-type washing machine.

Referring to FIGS. 9 and 10, in an embodiment, the lid lock 300 includes an upper lid 12, a casing 11, and the above-mentioned lock 100 and the control system 200 (not shown), wherein the upper lid 12 is buckled on the casing 11, and the lock 100 and the control system 200 are arranged in the casing 11, which are not shown in drawings except for the position of the lock 100.

Further, the upper lid 12 is provided with a locking hole 121 at a position corresponding to the lock 100. The locking portion 501 can be rotated and protrude relative to the casing 11, and be locked in the locking hole 121.

Referring to FIG. 9, when the locking portion 501 is rotated relative to the base 1 and retracted, the locking portion 501 can be retracted with respect to the casing 11 and into the casing 11, and thus the unlocking operation is performed.

Referring to FIG. 10, when the locking portion 501 is rotated and unfolded relative to the base 1, the locking portion 501 can protrude out of the casing 11 and into the locking hole 121 of the upper lid 12 to perform the locking operation.

In a third aspect of the present application, an embodiment of the present application provides a locking mechanism 5 for a lock.

In an embodiment, the lock includes a housing within which a locking mechanism 5 is arranged.

Referring to FIG. 3, the locking mechanism 5 includes a locking shaft 502 and a locking portion 501, and a fragile portion 503 located between the locking shaft 502 and the locking portion 501. When subjected to an external force greater than a predetermined threshold, the fragile portion 503 may be broken off. Here, the predetermined threshold may be set in advance as needed.

Further, the locking mechanism 5 is provided with a return spring 7, and the return spring 7 is sleeved on the locking shaft 502. In addition, a first protruding end 701 of the return spring is connected to the housing, and a second protruding end 702 of the return spring is connected to the locking portion 501.

In this way, when the fragile portion 503 is broken off, the second protruding end 702 will also be disconnected to the locking portion 501.

In a fourth aspect of the present application, an embodiment of the present application provides a lock, which includes the locking mechanism described in the third aspect of the present application.

In the description of the present specification, the reference terms such as "an embodiment", "some embodiments", "an example", "a specific example" and "some examples" mean that the particular features, structures, materials or characteristics described in combination of the embodiments or examples are included in at least an embodiment or example of the present application. Furthermore, the described particular features, structures, materials or characteristics may be combined in a proper manner in any one or more embodiments or examples. In addition, in the absence of contradiction, one skilled in the art can integrate and combine different embodiments or examples described in this specification and the features of different embodiments or examples.

In addition, the terms "first" and "second" are used for a descriptive purpose only and shall not be construed as indicating or implying relative importance or implicitly indicating the number of the indicated technical features. Thus, features defining "first" and "second" may explicitly or implicitly include at least one of the features. In the description of the present application, "a plurality of" means two or more, unless expressly limited otherwise.

In addition, the functional units in the embodiments of the present application may be integrated in a processing module, or may exist as physically independent units. Two or more units may also be integrated into one module. The integrated module can be realized in the form of hardware or in the form of a software function module. When the integrated module is realized in a form of the software function module and is sold or used as an independent product, it may be stored in a computer-readable storage medium. The storage medium may be a read-only memory, a magnetic disk, an optical disk, or the like.

The content described above are specific embodiments of the present application, but the protection scope of the present application is not limited thereto. Any person skilled in the art may easily anticipate various alternations or replacements of these embodiments within the technical scope disclosed in the present application, and all these alternations or replacements should be covered by the protection scope of the present application. Therefore, the protection scope of the present application should be defined by the claims.

What is claimed is:

1. A lock, comprising: a base, and a driving mechanism and a locking mechanism which are provided on the base, wherein a housing is buckled on the base, a cavity is formed between the housing and the base, and the driving mechanism and the locking mechanism are accommodated in the cavity;

under the role of the driving mechanism, the locking mechanism is rotatably connected to the base to perform a locking operation or an unlocking operation;

a return spring is sleeved on the locking mechanism, the return spring has a first protruding end connected to the housing and a second protruding end connected to the locking mechanism, in the unlocking operation, the return spring drives the locking mechanism to retract relative to the base;

the locking mechanism is connected to a control system; and in the unlocking operation, the control system determines that the locking mechanism is disconnected to the return spring according to the locking mechanism in an unfolded position relative to the base, and determines that the locking mechanism is connected to the return spring according to the locking mechanism in a retracted position relative to the base.

2. The lock according to claim 1, wherein the locking mechanism comprises a locking shaft and a locking portion, the locking shaft is rotatably connected to the base, and the return spring is sleeved on the locking shaft; and the locking portion is provided on an upper portion of the locking shaft and connected to the locking shaft through a fragile portion, and the locking portion is rotated on the locking shaft to unfold or retract relative to the base.

3. The lock according to claim 2, wherein the fragile portion is in a shape of curve, the locking portion is provided with an insertion hole, and the second protruding end passes through the insertion hole and is clamped on the locking portion.

4. The lock according to any one of claim 1 wherein the lock comprises a connecting mechanism accommodated in the cavity, the connecting mechanism has a first end connected to the driving mechanism through a sliding mechanism and a second end connected to the locking mechanism, the connecting mechanism is configured to convert a linear motion of the driving mechanism into a rotating motion of the locking mechanism; and the lock further comprises a circuit board electrically connected to a power supply and a dome switch connected to the sliding mechanism.

5. A lock, comprising: a base, and a driving mechanism and a locking mechanism which are provided on the base, wherein a housing is buckled on the base, a cavity is formed between the housing and the base, and the driving mechanism and the locking mechanism are accommodated in the cavity;

under the role of the driving mechanism, the locking mechanism is rotatably connected to the base to perform a locking operation or an unlocking operation;

a return spring is sleeved on the locking mechanism, the return spring has a first protruding end connected to the housing and a second protruding end connected to the locking mechanism, in the unlocking operation, the return spring drives the locking mechanism to retract relative to the base;

the locking mechanism is connected to a control system; and in the unlocking operation, the control system determines that the locking mechanism is disconnected to the return spring according to the locking mechanism in an unfolded position relative to the base, and determines that the locking mechanism is connected to the return spring according to the locking mechanism in a retracted position relative to the base;

wherein the lock comprises a connecting mechanism accommodated in the cavity, the connecting mechanism has a first end connected to the driving mechanism through a sliding mechanism and a second end connected to the locking mechanism, the connecting mechanism is configured to convert a linear motion of the driving mechanism into a rotating motion of the locking mechanism; and the lock further comprises a circuit board electrically connected to a power supply and a dome switch connected to the sliding mechanism;

wherein the circuit board includes a first contacting unit and a second contacting unit;

in the unfolded position of the locking mechanism with respect to the base, the dome switch comes into contact with the first contacting unit;

in the retracted position of the locking mechanism with respect to the base, the dome switch comes into contact with the second contacting unit; and in the unlocking operation, the control system determines that the locking section is disconnected to the return spring according to the dome switch in contact with the first contacting unit, and determines that the locking portion is connected to the return spring according to the dome switch in contact with the second contacting unit.

6. The lock of claim 5, wherein the control system comprises:

a driving control unit, configured to receive information of a previous power failure sent by a device and send an activation signal to the driving mechanism to rotate the locking mechanism relative to the base, to perform the locking or unlocking operation;

a breakage determining unit, configured to determine that the locking section is disconnected to the return spring according to the dome switch in contact with the first contacting unit in the unlocking operation, and determine that the locking section is connected to the return spring according to the dome switch in contact with the second contacting unit; and a running control unit, configured to send a stop-running signal to the device in a case of a disconnection between the locking portion and the return spring; send the activation signal to the driving mechanism again in a case of a connection between the locking portion and the return spring, to drive the sliding mechanism and the connecting mechanism to move by the driving mechanism, and rotate the locking mechanism relative to the base to perform the locking operation; and send a normal-running signal to the device.

7. The lock according to claim 6, wherein the lock further comprises a magnetic reed switch connected to the control system and conducted by a magnetic force.

8. The lock according to claim 7, wherein the magnetic reed switch is connected to the driving control unit; and the driving control unit is further configured to receive the information of the previous power failure sent by the device and a signal of the magnetic reed switch being in an on position, and send the activation signal to the driving mechanism.

9. The lock according to claim 8, wherein the magnetic reed switch is connected to the running control unit; and the running control unit is further configured to send a stop-running signal to the device when a signal of the magnetic reed switch being in an off position is received.

10. The lock according to claim 2 wherein the connecting mechanism comprises a crank lever with a first end and a second end, the locking mechanism comprises a main rotating shaft, and the locking mechanism is rotatably connected to the base through the main rotating shaft;

the first end of the crank lever is connected to the sliding mechanism, and the second end of the crank lever is connected to the main rotating shaft; and when the sliding mechanism moves, the main rotating shaft rotates relative to the base by a driving of the crank lever and drives the locking portion to rotate.

11. The lock according to claim 2 wherein an outside portion of the housing is provided with a window, and the locking portion in the retracted position is accommodated in the window.

12. A lid lock, comprising an upper lid, a casing, and the lock as claimed claim 1;

wherein the upper lid is buckled on the casing;

the lock is arranged in the casing, and the upper lid is provided with a locking hole at a position corresponding to the lock; and the locking portion rotatably protrudes relative to the casing and is locked in the locking hole.

13. A lock, comprising: a base, and a driving mechanism and a locking mechanism which are provided on the base, wherein a housing is buckled on the base, a cavity is formed between the housing and the base, and the driving mechanism and the locking mechanism are accommodated in the cavity;

under the role of the driving mechanism, the locking mechanism is rotatably connected to the base to perform a locking operation or an unlocking operation;

a return spring is sleeved on the locking mechanism, the return spring has a first protruding end connected to the housing and a second protruding end connected to the locking mechanism, in the unlocking operation, the return spring drives the locking mechanism to retract relative to the base;

the locking mechanism is connected to a control system; and in the unlocking operation, the control system determines that the locking mechanism is disconnected to the return spring according to the locking mechanism in an unfolded position relative to the base, and determines that the locking mechanism is connected to the return spring according to the locking mechanism in a retracted position relative to the base;

wherein an upper lid is buckled on a casing;

the lock is arranged in the casing, and the upper lid is provided with a locking hole at a position corresponding to the lock; and the locking portion rotatably protrudes relative to the casing and is locked in the locking hole;

wherein the upper lid is provided with a magnetic element, and a magnetic reed switch switches on under a magnetic force and the driving mechanism is connected to the power supply when the upper lid is buckled to the casing.

14. A locking mechanism for a lock, wherein the lock comprises a housing, the locking mechanism is arranged in the housing;

the locking mechanism comprises a locking shaft that defines a rotary axis and a locking portion, and a fragile portion located between the locking shaft and the locking portion, the fragile portion is broken off when subjected to an external force greater than a predetermined threshold;

the locking mechanism is provided with a return spring sleeved on the locking shaft, the return spring comprises a first protruding end connected to the housing and a second protruding end connected to the locking portion at a location that is spaced further from the rotary axis of the locking shaft than the fragile portion, wherein:

when the second protruding end of the return spring is connected to the locking portion, the return spring provides a biasing force to the locking mechanism; and when the fragile portion is broken off, the second protruding end of the return spring is disconnected from the locking portion and the return spring does not provide a biasing force to the locking mechanism.

15. A lock comprising the locking mechanism of claim 14.

16. A lock for locking a lid of an appliance, the lock comprising:

a base;

a driving mechanism that is actuatable for driving the lock between an unlocked state that allows opening of the lid of the appliance and a locked state that prevents opening of the lid of the appliance;

a locking mechanism that is moved by the driving mechanism between:

a retracted position that defines the unlocked state of the lock; and an unfolded position that defines the locked state of the lock;

a switch communicating with the locking mechanism to indicate whether the locking mechanism is in the retracted position or the unfolded position;

a control system that includes:

a breakage determining unit communicating with the switch and configured to determine a breakage state of the locking mechanism based on a position of the locking mechanism;

a running control unit communicating with the breakage determining unit and configured to allow or prevent operation of the appliance based on the determination of the breakage determining unit.

17. The lock of claim 16, wherein the breakage determining unit determines a broken state of the locking mechanism when:

the driving mechanism was actuated to attempt an unlocking operation; and the breakage determining unit determines that the switch indicates that the locking mechanism remains in the unfolded position.

18. The lock of claim 17, wherein the locking mechanism includes:

a locking mechanism first segment that is pivotably mounted with respect to the base for moving the lock mechanism between the retracted position and the unfolded position;

a locking mechanism second segment extending generally perpendicularly from the locking mechanism first segment and defining a locking portion of the locking mechanism that engages the lid when the locking mechanism is in the unfolded position to define the locked state and is disengaged from the lid when the locking mechanism is in the retracted position to define the unlocked state;

the lock further comprising:

a return spring that connects the base to the locking portion of the locking mechanism to bias the locking mechanism to the retracted position in a default state.

19. The lock of claim 18, wherein the breakage determining unit determines that the locking portion of the locking mechanism has been broken from the first segment of the locking mechanism and disconnected from the return spring based on the indication of the switch that the locking mechanism remains in the unfolded position after the driving mechanism was actuated to attempt an unlocking operation.

* * * * *